US009493943B1

(12) United States Patent
Smith

(10) Patent No.: US 9,493,943 B1
(45) Date of Patent: Nov. 15, 2016

(54) FLASHING ATTACHMENT APPARATUS AND METHOD

(71) Applicant: Walter J. Smith, Pensacola, FL (US)

(72) Inventor: Walter J. Smith, Pensacola, FL (US)

( * ) Notice: Subject to any disclaimer, the term of this patent is extended or adjusted under 35 U.S.C. 154(b) by 0 days.

(21) Appl. No.: 14/789,426

(22) Filed: Jul. 1, 2015

Related U.S. Application Data

(60) Provisional application No. 62/019,463, filed on Jul. 1, 2014.

(51) Int. Cl.

| | |
|---|---|
| ***E04B 1/68*** | (2006.01) |
| ***E04B 1/66*** | (2006.01) |
| *E04D 13/14* | (2006.01) |
| *E04D 13/147* | (2006.01) |

(52) U.S. Cl.
CPC ..... *E04B 1/665* (2013.01); *E04D 13/1415* (2013.01); *E04D 13/1478* (2013.01)

(58) Field of Classification Search
CPC ..... E04D 13/1415; E04D 13/155; E04D 13/1478; E04D 2013/1422; B60J 10/0068; B60J 10/0065
USPC ..... 52/59–62, 97, 716.8, 169.14
See application file for complete search history.

(56) References Cited

U.S. PATENT DOCUMENTS

| | | | | |
|---|---|---|---|---|
| 1,700,619 | A * | 1/1929 | Young | E04D 13/1415 52/61 |
| RE17,818 | E * | 9/1930 | Young | E04D 13/1415 52/61 |
| 2,226,886 | A * | 12/1940 | Willis | E04B 1/6809 404/47 |
| 2,702,514 | A * | 2/1955 | Dalley | E04D 13/1415 52/61 |
| 3,238,689 | A * | 3/1966 | Cook, Jr. | B60J 10/0068 49/490.1 |
| 3,241,272 | A * | 3/1966 | Edwards | E04B 1/644 52/302.6 |
| 3,430,387 | A * | 3/1969 | Clapham | B60J 10/0005 49/490.1 |
| 3,608,255 | A * | 9/1971 | Chomes | E04D 13/1415 52/61 |
| 5,123,208 | A * | 6/1992 | Kirby | E04D 13/1415 52/58 |
| 5,392,576 | A * | 2/1995 | Yeamans | E04D 5/146 160/391 |
| 8,176,688 | B1 | 5/2012 | Smith | |
| 2002/0115367 | A1* | 8/2002 | Lolley | B32B 15/14 442/6 |
| 2010/0180517 | A1* | 7/2010 | Perrot, Jr. | E04D 13/155 52/60 |
| 2011/0192095 | A1* | 8/2011 | Sawada | E04D 13/1478 52/97 |
| 2011/0277393 | A1* | 11/2011 | Hohmann, Jr. | B32B 33/00 52/62 |

* cited by examiner

*Primary Examiner* — Babajide Demuren
(74) *Attorney, Agent, or Firm* — J. Nevin Shaffer, Jr.

(57) ABSTRACT

An improved flashing attachment apparatus and method consists of a mesh with a length and a width where the mesh is folded over along its width to create a closed end and an open end along its length and a top and a bottom. A membrane is connected with the mesh between the top and the bottom of the mesh where the membrane extends past the open end at least partially along the length of the mesh.

20 Claims, 4 Drawing Sheets

FLASHING ATTACHMENT APPARATUS AND METHOD

CROSS REFERENCE TO RELATED APPLICATION

This application claims the benefit of previously filed U.S. provisional patent application No. 62/019,463 filed Jul. 1, 2014 for an "Improved Flashing Attachment Apparatus and Method". The Applicant hereby claims the benefit of this provisional application under 35 U.S.C. §119. The entire content of this provisional application is incorporated herein by this reference.

FIELD OF THE INVENTION

This invention relates to an improved flashing attachment device. In particular, in accordance with one embodiment, the invention relates to an improved flashing attachment apparatus consisting of a mesh with a length and a width where the mesh is folded over along its width to create a closed end and an open end along its length and a top and a bottom. A membrane is connected with the mesh between the top and the bottom of the mesh where the membrane extends past the open end at least partially along the length of the mesh.

BACKGROUND OF THE INVENTION

A problem exists in construction of structures with regard to sealing the structures against degrading elements in general and moisture in particular. The problem, for example only, is understood in the art with regard to concrete masonry units with walls that have an exterior veneer, such as brick for example only. Presently, once the wall is built, prior to installation of the brick veneer, the surface of the wall is covered with a waterproof flashing. This covering is required to be held in place and sealed. The current state of the art is to use a termination bar. Termination bars are typically long metal bars about one inch wide and are attached to the top of the base wall with screws. The termination bar is designed to cover the top edge of the flashing attached to the face of the wall. Typically, installation of the termination bar requires two people with power tools to install screws through the termination bar and the flashing into the wall. Thereafter additional waterproofing may be added along the top of the termination bar and in fact additional sealant usually is required to seal the termination bar itself.

This is a time consuming and exacting process. It is labor intensive and relatively expensive. Further, the termination bar must be attached after the waterproof flashing is attached to the wall. Thus, typically, the prior art termination bar is installed just before the brick veneer is added, limiting the amount of time available for inspection to see if it was installed properly. Still further, termination bars presently are constructed of metal and are therefore difficult to modify when construction requires it. That is, corners, both interior and exterior bending corners, require the termination bar to be cut and bent on site which requires precision use of metal saws. When the corner is not a right angle corner but is instead a rounded or curved corner the process of modifying a current termination bar is extremely difficult and nearly impossible for the ordinary person. Additionally, the termination bar typically does nothing to reinforce the joint surface to which it is attached and in fact may weaken it.

Thus, there is a need in the art for an apparatus and method for an improved flashing attachment that is easy to use, simple to install, is relatively inexpensive, requires no power tools to install, and is quickly adaptable to provide flashing attachment at corners, interior, exterior and both straight and curved.

It therefore is an object of this invention to provide an improved flashing attachment apparatus and method that is easy to use, simple to install, is relatively inexpensive, requires no power tools to install, and is quickly modifiable without power tools and saws to provide flashing attachment at corners, interior, exterior and both straight and curved. It is a further object of the invention to provide an improved flashing attachment that may be applied to a surface well in advance of the application of a veneer to the surface and prior even to the application of a waterproof flashing to the surface.

It is a further object of the invention to provide an improved flashing attachment that requires no additional sealant once installed and which provides additional joint reinforcement to the joint in the locations where it is attached.

SUMMARY OF THE INVENTION

Accordingly, the improved flashing attachment apparatus and method of the present invention, according to one embodiment, includes a mesh with a length and a width where the mesh is folded over along its width to create a closed end and an open end along its length and a top and a bottom. A membrane is connected with the mesh between the top and the bottom of the mesh where the membrane extends past the open end at least partially along the length of the mesh.

All terms used herein are given their common meaning so that "mesh" identifies and describes a material that includes open spaces from one side to the other, top to bottom. "Folded over" describes a mesh bent in half, for example, with a part of it creating a top and another part creating a bottom and a "closed end" at the bend and an "open end" at the two unconnected edges. Certainly, the mesh may be a straight, unfolded form such that, in that case, the "closed" end is simply one edge of the mesh and the "open end" is the end of the mesh from which the membrane extends. "Membrane" describes a material separate and apart from the mesh of the invention and one which is not primarily a mesh. Certainly at a certain level every material that is "solid" in every day use, is constructed of atoms which are in fact spaced apart. As used herein, mesh and membrane are given their ordinary meaning such that a mesh allows material, such as water, for example only, to pass easily through it while the membrane repels water with its non-porous and perhaps "waterproof" surface. "Waterproof" is used to describe a material that repels water or that is coated with a substance, such as wax or oil or plastic, which prevents an underlying membrane from getting wet and allowing water to pass though it. Any waterproof membrane or membrane covered with a waterproof additive now known or hereafter developed is included within the scope or the invention.

In one aspect, the membrane is connected in spaced apart relation to the closed end such that at least some of the mesh is not interrupted by the membrane from the top of the mesh through the mesh to the bottom of the mesh. Here "interrupted" describes a condition in which the membrane does not cover or obstruct at least some of the spaces in the mesh so that uninterrupted openings exist from top to bottom of the mesh at some locations.

In another aspect, the membrane is self adhering membrane. "Self adhering" describes a membrane that includes an adhesive of some type such that the self adhering membrane is attachable to a surface without the need to add adhesive to the membrane or the surface.

In one aspect, the self adhering membrane is a waterproof membrane and includes a removable cover shielding adhesive on the self adhering membrane.

In another aspect, the mesh includes interconnected mesh arms where the interconnected mesh arms consist of a combination of horizontal mesh arms and vertical mesh arms such that the interconnected mesh arms form spaces. Here "horizontal" and "vertical" are used to describe relative orientation and not precisely right angle relationships. Generally, it is used to distinguish up and down from left and right. "Arms" is used to describe elements of the mesh that are solid and which form the mesh itself, such as strands of metal or plastic, for example only and not by limitation. Certainly, the mesh may be of any configuration so long as the open spaces are provided from top through to the bottom, as for example, circular holes and irregular forms of any useful configuration. Nonetheless, in any configuration, the "arms" are the sections of the mesh that create the openings or, conversely, the openings in the mesh create the "arms".

In one aspect, the folded over mesh is connected along its length by each horizontal mesh arm such that the mesh is held together when all but one of the horizontal mesh arms are cut. Here is described a feature of the invention in which the device is held together by the mesh even when all but one of the arms of the mesh are cut or removed. This element of the invention allows the device to be formed to accommodate corners, both interior and exterior, as well as heretofore difficult or impossible to create curved corner flashing attachments as will be described more fully hereafter.

In another aspect, the membrane is held in place with the mesh and connected with the mesh by compression of the top of the mesh with the bottom of the mesh. Here is described a connection by contact of the top with the mesh in between the bottom. When the mesh is made of metal, for example only, the compression of the top with the bottom, traps the membrane in between since the metal, once forced together, does not thereafter separate. Certainly, it may be that other means of connection may be used, such as heat to melt a plastic mesh somewhat to meld the membrane with the mesh or glue or any other connection device now known or hereafter developed, for example only.

In a further aspect, at least some portion of the membrane is bent at an angle along the length of the mesh. Here it is described that once the membrane is secured in place in between the top and the bottom of the mesh, a part of the membrane is bent at an angle along the length of the mesh. In another aspect, the width of the portion of the membrane that is bent is greater than the width of the membrane that is unbent. Here an "L" shape is described with a long portion and a short portion, the long portion being bent, but, certainly, the portions may be the same length as deemed useful.

According to another embodiment of the invention, an improved flashing attachment apparatus includes a mesh with a length and a width where the mesh is folded over along its width to create a closed end and an open end along its length and top and a bottom where the mesh includes interconnected mesh arms where the interconnected mesh arms consist of a combination of horizontal mesh arms and vertical mesh arms such that the interconnected mesh arms form spaces. A waterproof membrane is connected with the mesh between the top and the bottom of the mesh where the waterproof membrane extends past the open end at least partially along the length of the mesh and where the membrane is connected in spaced apart relation to the closed end such that at least some of the mesh is not interrupted by the membrane from the top of the mesh through the mesh to the bottom of the mesh and where at least some portion of the membrane is bendable. By "bendable" a membrane is described that may be generally rigid enough to maintain its form without support yet which also maintains its integrity when bent and which can be bent when desired without degrading the membrane.

In another aspect, the folded over mesh is connected along its length by each horizontal mesh arm such that the mesh is held together when all but one of the horizontal mesh arms are cut.

In one aspect, the width of the portion of the membrane that extends from the open end of the mesh is greater than the width of the membrane that is connected between the top and the bottom of the mesh. In a further aspect, the mesh is welded wire mesh. In one aspect, the mesh is galvanized sixteen gauge wire mesh. In another aspect, the mesh is approximately three inches in width before folding and approximately one and one-half inches in width when folded over and where the horizontal mesh arms and the vertical mesh arms form rectangular spaces.

In one aspect, the waterproof membrane is self adhering membrane and where the self adhering membrane includes a removable cover shielding adhesive on the self adhering membrane.

According to another embodiment of the invention, an improved flashing attachment method includes:

a. providing a mesh with a length and a width where the mesh is folded over along its width to create a closed end and an open end along its length and top and a bottom where the mesh includes interconnected mesh arms where the interconnected mesh arms consist of a combination of horizontal mesh arms and vertical mesh arms such that the interconnected mesh arms form spaces; and a waterproof membrane connected with the mesh between the top and the bottom of the mesh where the waterproof membrane extends past the open end at least partially along the length of the mesh and where the membrane is connected in spaced apart relation to the closed end such that at least some of the mesh is not interrupted by the membrane from the top of the mesh through the mesh to the bottom of the mesh; where at least some portion of the membrane is bent at an angle along the length of the mesh; and b. placing the mesh on a object with a top surface and a front face such that at least the closed end of the mesh is on the top surface and the waterproof membrane extends from the open end of the mesh and at least a portion of the waterproof membrane that is bent covers at least some of the front face of the object beyond the open end of the mesh.

In one aspect, the waterproof membrane includes a side with adhesive where the side with adhesive is exposed to the front surface of the object. In another aspect, the front surface of the object includes a covering and the adhesive on the waterproof membrane is connected with the covering.

In a further aspect, the method includes at least some of the horizontal arms are cut such that the mesh may be bent while at least one horizontal arm remains connected along the length of the mesh.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
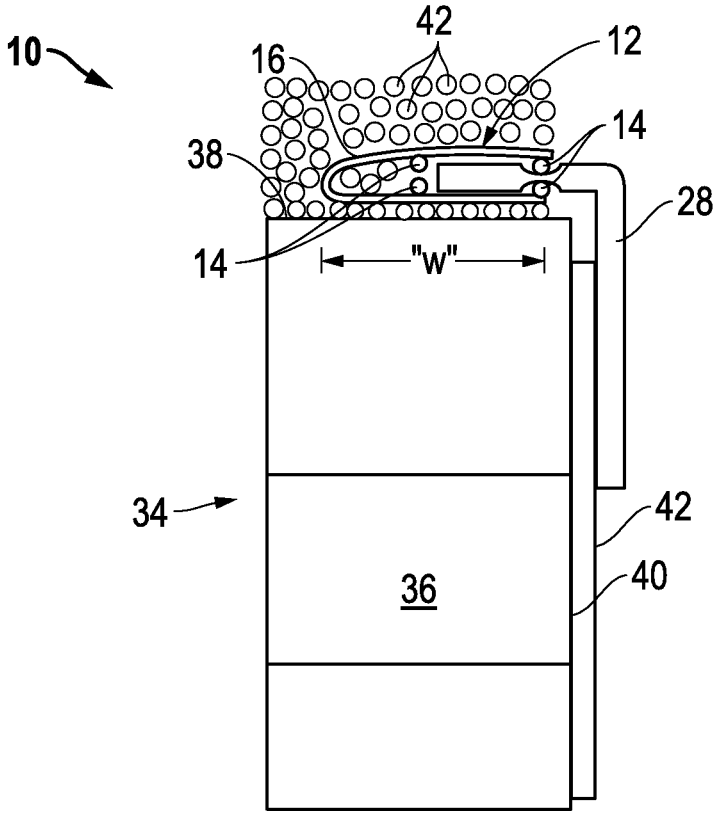
FIG. 1 is a side view of the improved flashing attachment of the present invention shown connected to an object.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-8. With specific reference to FIGS. 1, 2 and 3, an improved flashing attachment apparatus 10 includes a mesh 12 with a width "W", preferably where the mesh 12 is folded over along its width, such that the resulting width 'w" is less than the starting width "W". Preferably, the starting width "W" of mesh 12 is approximately three inches and the resulting width "w" after folding, as illustrated, is approximately one and one-half inches, for example only and not by limitation. Said another way, when folded, width "W" is equal to approximately two times the width "w".

Figure 2:
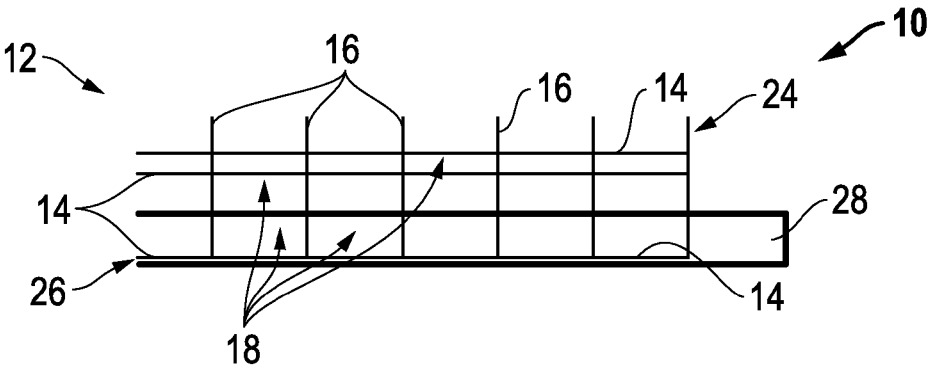
FIG. 2 is a top view of the invention of FIG. 1.

Mesh 12 includes horizontal mesh arms 14 and vertical mesh arms 16 as more clearly seen in FIG. 2, for example. Horizontal mesh arms 14 and vertical mesh arms 16 are interconnected. That is, horizontal mesh arms 14 and vertical mesh arms 16 are attached at the intersection by welding, gluing, heating, or in any known manner or any manner hereafter developed such that the arms 14 and 16 are fixed with each other at the point they intersect. This forms a stable structure, mesh 12, such that mesh 12 can be bent, folded, as described above while still retaining the interconnected relationship of the mesh arms 14 and 16.

The horizontal mesh arms 14 and vertical mesh arms 16 are spaced apart any desired distance such that spaces 18 are created in between the intersecting arms 14 and 16. The figures illustrate a regular grid of horizontal arms 14 and vertical arms 16 creating rectangular spaces 18 but, again, any orientation or shape of spaces 18 is included within the scope of the present invention.

Importantly, mesh 12 when folded has a top 20 and a bottom 22 and spaces 18 extend from the top 20 of mesh 12 through the bottom 22 of mesh 12. Mesh 12 also has a length "L". It is anticipated that mesh 12 will be made in sections of certain lengths and joined with each other on site as described hereafter.

Figure 4:
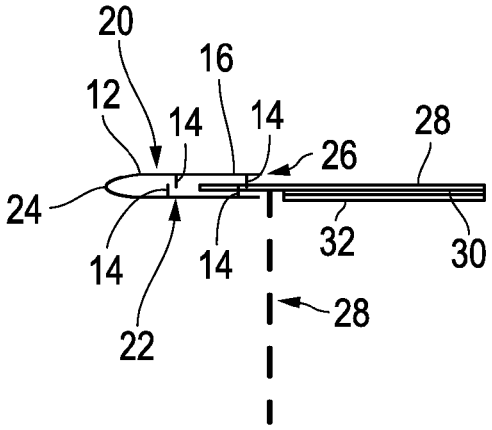
FIG. 4 is a side view of the invention of FIG. 1 showing the membrane extended and then, in dashed lines, bent.

As shown in FIG. 1, mesh 12 includes a closed end 24 and an open end 26 and membrane 28 is inserted into, and/or attached directly to, the open end 26 and, preferably, in between the top 20 and the bottom 22 of mesh 12. This relationship is shown in FIG. 4 as well, as will be discussed more fully hereafter. Membrane 28 in one aspect is a self adhering, waterproof membrane 28 with adhesive 30 on one side of membrane 28. Further, a removable cover 32 may be provided to cover the adhesive 30 prior to connection of the adhesive 30 to another object as discussed more fully hereafter.

Membrane 28 is connected to one end of mesh 12, such as at the "open end" 26, and preferably between top 20 and bottom 22 of mesh 12 in any suitable manner as by compressing top 20 with bottom 22 after insertion of membrane 28 into the open end 26 of mesh 12. Applicant has found that when using the preferred sixteen gauge galvanized wire mesh 12, once the membrane 28 is compressed in between, mesh 12 maintains the connection and does not relax or allow membrane 28 to slip out of the open end 26. Certainly, again, it may be that the membrane 28 is connected directly to mesh 12 along just its edge at the open end 26, such that none of the membrane 28 is compressed between the top 20 and the bottom 22.

FIG. 1 illustrates the use of the improved flashing apparatus 10 in conjunction with an object 34. Here, object 34 is a wall 36 with a top 38 and a front face 40. In use, after insertion and connection of membrane 28 with mesh 12, at least the closed end 24 and, preferably, all of mesh 12 is placed on the top 38 of wall 36. Membrane 28 extends out of the open end 26 of mesh 12 beyond the top 38 of wall 36 as shown. Improved flashing attachment apparatus 10 may be secured in place by mortar 42. Mortar 42 fills the spaces 18 in mesh 12 from the top 20 and the bottom 22 of mesh 12 and, where membrane 28 is missing, all the way through mesh 12 from top to bottom. This feature makes the improved flashing attachment 10 of the present invention a part of the joint and adds strength to the joint instead of weakening it by the addition of some unintegrated solid structure, such as the prior art termination bar, for example only.

Just as importantly, the present invention allows the mesh 12 and membrane 28 to be connected in place with an object 34 before any flashing 42 is added to the front face 40 of wall 36, for example. This allows inspection of improved flashing attachment apparatus 10 well before the apparatus is covered up by a veneer of some sort. In particular, when corners are involved, as will be discussed more fully hereafter, it ensures that the corners may be found to be fully and properly protected.

Once flashing 42 is attached to the front face 40 of wall 36, membrane 28 is bent to cover the top edge 44 of flashing 42. Where membrane 28 is flexible and naturally bends downward after mesh 12 is secured in place at the top 38 of wall 36, membrane 28 is easily lifted while flashing 42 is installed and then allowed to cover the top edge 44 of flashing 42. When present, removable cover 32 is removed, adhesive 30 exposed and membrane 28 is pressed into contact with flashing 42.

Figure 3:
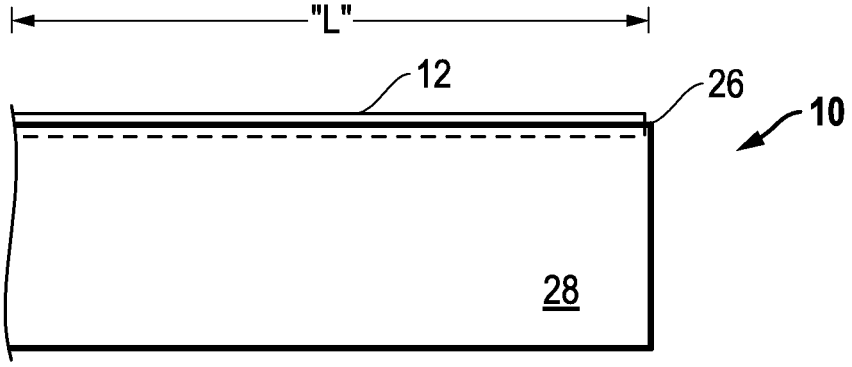
FIG. 3 is a front view of the invention of FIG. 1.

Referring to FIGS. 2 and 3 it is illustrated that a small portion of membrane 28 is captured in mesh 12 as more of membrane 28 extends beyond the open end 26 of mesh 12. More or less membrane captured or extending is appropriate as may be desired. FIG. 2 shows that membrane 28 may extend beyond the length of mesh 12 such that some portion of membrane 28 is not captured between top 20 and bottom 22 as will be described more fully hereafter with regard to FIGS. 5A, B and C.

Referring now to FIG. 4, it is shown again that membrane 28 extends from the open end 26 of mesh 12 but is spaced apart from, does not abut or contact, the closed end 24 of mesh 12. Further, the portion of membrane 28 that extends from open end 26 may be bent to include an angle, shown in dashed lines, with the portion within the mesh 12 aligned with the mesh 12 and the portion outside of the mess 12 at an angle to the mesh 12. The angle illustrated approximates a right angle but, of course, any attainable angle is included. Adhesive 30 covered with removable cover 32 is shown as well.

Referring now to FIGS. 5 A, B and C, various schemes for connection of one section of mesh 12 with another section of mesh 12 so as to cover the space between the two sections of mesh are detailed. In 5A, each section of mesh 12 includes a section of membrane 28 that extends beyond the end 46 of mesh 12. The extended sections of membrane 28 are then overlapped to create a sealed surface beneath.

Figure 5A:
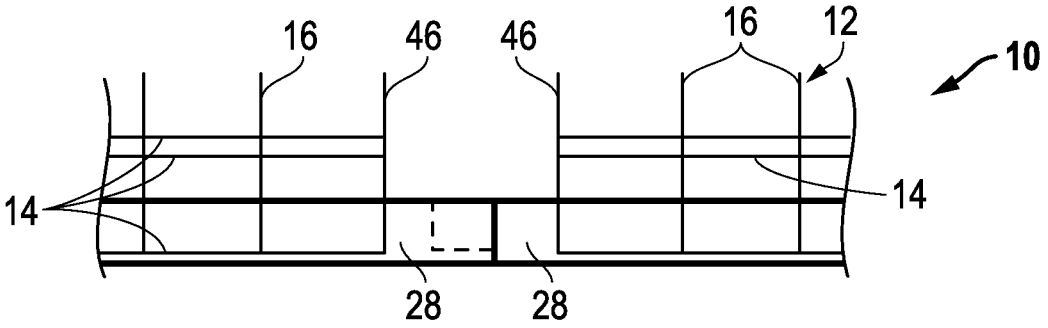
FIGS. 5A, 5B and 5C are top views of the invention of FIG. 1 illustrating joining sections of mesh by means of overlapping membranes in 5A; one extended membrane in 5B; and an added section of membrane not connected to mesh in 5C.
Figure 5B:
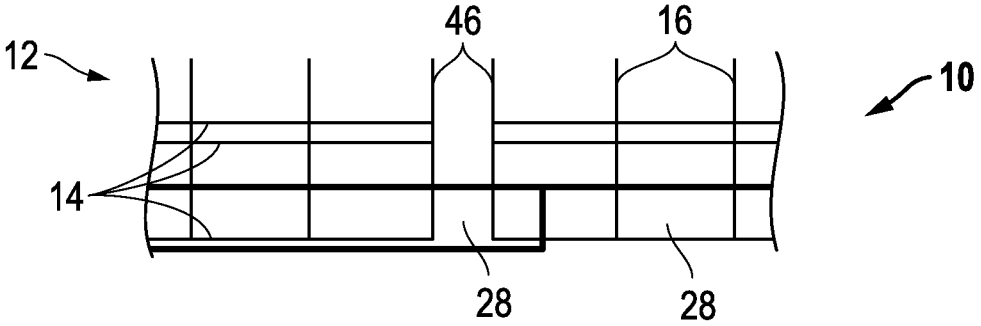

In FIG. 5B, only one section of mesh 12 includes membrane 28 that extends beyond the end 46. In this case, the section with the extension is applied over the membrane of the section without the extension after the section without the extension is connected with a wall 36, for example, as discussed above.

Figure 5C:
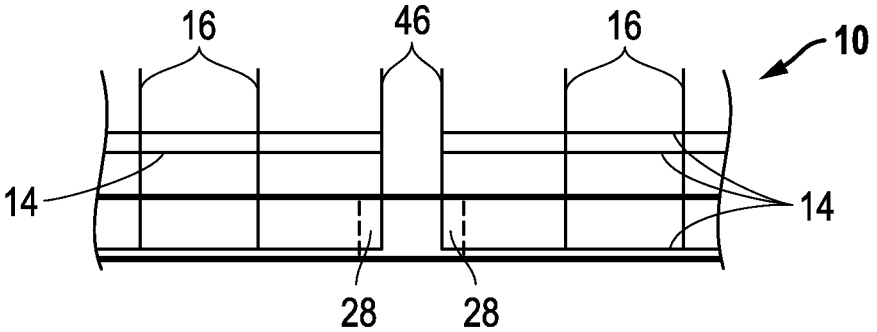

FIG. 5C shows both sections with extensions but with the overlap occurring underneath the sections of mesh 12 as shown whereas in FIG. 5A, the overlap occurred outside of either mesh 12 section.

Figure 6A:
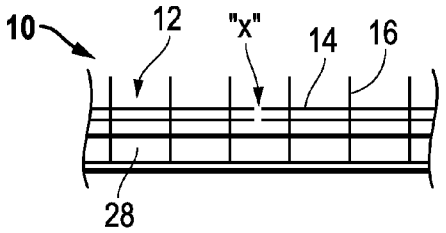
FIGS. 6A and 6B illustrate the invention of FIG. 1 with cuts of mesh arms in 6A, so as to create an interior corner in 6B.
Figure 6B:
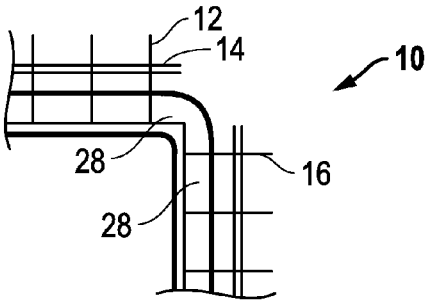

Referring now to FIGS. 6A and 6B, 6A shows at least some of the horizontal arms 14 cut at "X". Once the cut is made, mesh 12 can easily be bent to form an interior corner as shown in FIG. 6B. If need be, membrane 28 will stretch in the portion of membrane 28 at the cut. For clarity, membrane 28 is illustrated with darker lines.

Figure 7A:
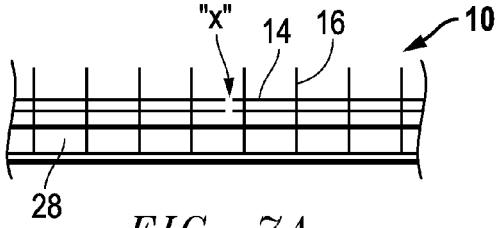
FIGS. 7A and 7B illustrate the invention of FIG. 1 with cuts of mesh arms in 7A, so as to create an exterior corner in 7B.
Figure 7B:
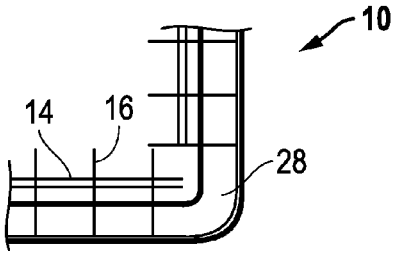

Referring to FIGS. 7A and 7B, 7A shows at least some of the horizontal arms 14 cut at "X". More or less arms 14, and even vertical arms 16, may be removed as needed to allow mesh 12 to be bent into the shape of the desired exterior corner shown in FIG. 7B. So long as at least one horizontal arm 14 remains uncut, mesh 12 will hold together.

Figure 8A:
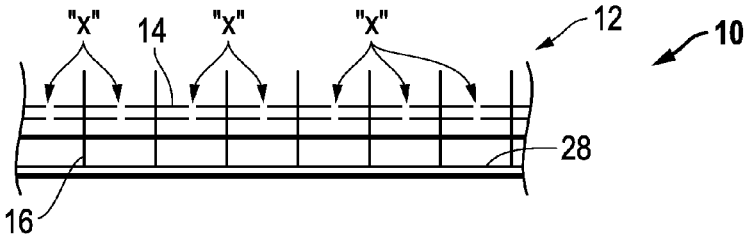
FIGS. 8A and 8B illustrate the invention of FIG. 1 with cuts of the mesh arms in 8A, so as to create a curved corner in 8B.
Figure 8B:
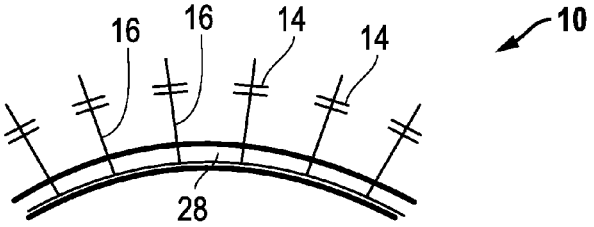

Referring to FIGS. 8A and 8B, FIG. 8A shows at least some of the horizontal arms 14 cut at several locations along the length of mesh 12 and not just at one area at "X". FIG. 8B shows the creation of the curved corner as a result.

By way of continued explanation, the Applicant's improved flashing attachment apparatus and method 10 may be created from common components such as a three inch wide strip of galvanized welded wire fabric (WWF) in at least sixteen gauge. The mesh may be in one inch by one-half inch patterns or whatever is desired. The one-half inch dimension of the mesh 12 is oriented to be continuous along the length "L" of the device with the one inch dimension from the open end 26 to the closed end 28, width "w", for example only and not by way of limitation.

The second major component is a three inch wide continuous strip of peel and stick waterproofing membrane 28 with a removable paper backing 32. The removable paper backing 32 remains in place until the device is used in construction at which time the paper is removed to allow the membrane 28 to be attached with adhesive 30 to the flashing 42, once flashing 42 is actually added, as described above. Preferably, the membrane 28 and the flashing 42 are the same material.

Fabrication of the improved flashing attachment apparatus is a three step process: first the WWF is bent in half creating an approximately three-inch wide continuous strip, with a gap at the exposed edges of the bent mesh 12, the open end 26, sufficient to easily insert the membrane 28. Next, one and one-half inches, and preferably no less than one-half inch of membrane 28 is inserted into the open end 26 along the entire length. Finally, once the membrane 28 is inserted, the open end 26 is pressed tightly together so that the membrane 28 is securely held by the mesh 12.

In use, the mesh 12 is set on the top 38 of an object 34, such as wall 36, as discussed and illustrated. The mesh 12 is embedded in mortar and covered in mortar and sealed within spaces 18 with mortar such that mesh 12 and a portion of membrane 28 actually reinforce the joint at the place where it is installed. Additional sections of the device may be added and continuity maintained by overlapping sections of membrane 28 as discussed and illustrated herein. If a section of mesh 12 is too long it and any membrane 28 that is not needed may simply be cut off by hand with wire cutters. Power tools are not necessary. Once installed, the improved flashing attachment apparatus 10 may be inspected for proper installation even before flashing 42 is attached. The present invention may be used on walls, above doors, and windows and any other locations where flashing is required.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An improved flashing attachment apparatus comprising:

a. a mesh with a length and a width wherein said mesh has a closed end and an open end along its length and a top and a bottom wherein said mesh includes interconnected mesh arms wherein said interconnected mesh arms consist of a combination of horizontal mesh arms and vertical mesh arms such that said interconnected mesh arms form spaces and wherein said mesh is connected along its length by each horizontal mesh arm such that said mesh is held together when all but one of said horizontal mesh arms are cut; and b. a membrane connected with said mesh at said open end wherein said membrane extends past said open end at least partially along said length of said mesh.

2. The apparatus of claim 1 wherein said membrane is connected in spaced apart relation to said closed end such that at least some of said mesh is not interrupted by said membrane from said top of said mesh through said mesh to said bottom of said mesh.

3. The apparatus of claim 1 wherein said membrane is self adhering membrane.

4. The apparatus of claim 3 wherein said self adhering membrane is a waterproof membrane and includes a removable cover shielding adhesive on said self adhering membrane.

5. The apparatus of claim 1 wherein said mesh is folded over and wherein said membrane is held in place with said mesh and connected with said mesh by compression of some of said membrane by said top of said mesh with said bottom of said mesh with some of said membrane in between said top and said bottom.

6. The apparatus of claim 1 wherein at least some portion of said membrane is bent at an angle along the length of said mesh.

7. The apparatus of claim 6 wherein the width of said portion of said membrane that is bent is greater than the width of said membrane that is unbent.

8. An improved flashing attachment apparatus comprising:

a. a mesh with a length and a width wherein said mesh is folded over along its width to create a closed end and an open end along its length and top and a bottom wherein said mesh includes interconnected mesh arms wherein said interconnected mesh arms consist of a combination of horizontal mesh arms and vertical mesh arms such that said interconnected mesh arms form spaces wherein said folded over mesh is connected along its length by each horizontal mesh arm such that said mesh is held together when all but one of said horizontal mesh arms are cut; and b. a waterproof membrane connected with said mesh between said top and said bottom of said mesh wherein said waterproof membrane extends past said open end at least partially along said length of said mesh and wherein said membrane is connected in spaced apart relation to said closed end such that at least some of said mesh is not interrupted by said membrane from said top of said mesh through said mesh to said bottom of said mesh;

c. wherein at least some portion of said membrane is bendable.

9. The apparatus of claim 8 wherein the width of said portion of said membrane that extends from the open end is greater than the width of said membrane that is connected between the top and the bottom of said mesh.

10. The apparatus of claim 8 wherein said mesh is welded wire mesh.

11. The apparatus of claim 10 wherein said mesh is galvanized sixteen gauge wire mesh.

12. The apparatus of claim 8 wherein the mesh is approximately three inches in width before folding and approximately one and one-half inches in width when folded over and wherein said horizontal mesh arms and said vertical mesh arms form rectangular spaces.

13. The apparatus of claim 8 wherein said waterproof membrane is self adhering membrane and wherein said self adhering membrane includes a removable cover shielding adhesive on said self adhering membrane.

14. An improved flashing attachment method comprising:

a. providing a mesh with a length and a width wherein said mesh is folded over along its width to create a closed end and an open end along its length and top and a bottom wherein said mesh includes interconnected mesh arms wherein said interconnected mesh arms consist of a combination of horizontal mesh arms and vertical mesh arms such that said interconnected mesh arms form spaces; and a waterproof membrane connected with said mesh between said top and said bottom of said mesh wherein said waterproof membrane extends past said open end at least partially along said length of said mesh and wherein said membrane is connected in spaced apart relation to said closed end such that at least some of said mesh is not interrupted by said membrane from said top of said mesh through said mesh to said bottom of said mesh; wherein at least some portion of said membrane is bendable wherein at least some of said horizontal arms are cut such that said mesh may be bent while at least one horizontal arm remains connected along the length of said mesh; and b. placing said mesh on a object with a top surface and a front face such that at least said closed end of said mesh is on said top surface and said waterproof membrane extends from said open end of said mesh and said portion of said waterproof membrane that is bendable covers at least some of said front face of said object beyond the open end of said mesh.

15. The method of claim 14 claim wherein said waterproof membrane includes a side with adhesive wherein said side with said adhesive is exposed to said front surface of said object.

16. The method of claim 15 wherein said front surface of said object includes a covering and said adhesive on said waterproof membrane is connected with said covering.

17. The apparatus of claim 1 wherein said mesh is welded wire mesh.

18. The apparatus of claim 1 wherein said mesh is galvanized sixteen gauge wire mesh.

19. The apparatus of claim 1 wherein the mesh is approximately three inches in width before folding and approximately one and one-half inches in width when folded over and wherein said horizontal mesh arms and said vertical mesh arms form rectangular spaces.

20. The method of claim 14 wherein said mesh is selected from a group of mesh consisting of: welded wire mesh and galvanized sixteen gauge wire mesh.

* * * * *